US007231680B1

(12) United States Patent
Hafford et al.

(10) Patent No.: US 7,231,680 B1
(45) Date of Patent: Jun. 19, 2007

(54) DIABETIC SHEET SUPPORT

(76) Inventors: George L. Hafford, 509 N. Wakeford, Norris City, IL (US) 62869; Brenda Hafford, 509 N. Wakeford, Norris City, IL (US) 62869

( * ) Notice: Subject to any disclaimer, the term of this patent is extended or adjusted under 35 U.S.C. 154(b) by 0 days.

(21) Appl. No.: 11/387,593

(22) Filed: Mar. 23, 2006

(51) Int. Cl.
*A47C 21/02* (2006.01)

(52) U.S. Cl. ..... 5/505.1

(58) Field of Classification Search ..... 5/505.1, 5/504.1, 506.1

See application file for complete search history.

(56) References Cited

U.S. PATENT DOCUMENTS 1,072,490 A * 9/1913 Oilar ..... 5/505.1
1,577,089 A * 3/1926 Whitford ..... 5/505.1
2,674,750 A * 4/1954 Moore ..... 5/505.1
3,153,795 A * 10/1964 Emery ..... 5/505.1
3,317,932 A * 5/1967 Gibbons, Sr. ..... 5/505.1
3,680,158 A 8/1972 Speed
4,937,903 A 7/1990 Joly et al.
5,881,406 A 3/1999 Cobb

* cited by examiner

*Primary Examiner*—Alexander Grosz
(74) *Attorney, Agent, or Firm*—Raymond M. Galasso; Galasso & Associates, LP

(57) ABSTRACT

The bed cover support is designed to provide a way of supporting the sheets/blankets and preventing them from resting on the feet of an individual laying in bed. The bed cover support includes a first adjustable height bar and a second adjustable height bar which allows the bed cover support to adjust to varying mattress heights. The first adjustable height bar and the second adjustable height bar each have a support bar extending outward which fits between the mattress and box springs. Attached to the top of the first adjustable height bar and the second adjustable height bar is a cover support bar which supports the sheets/blankets preventing them from resting on the sleeping individual. The bed cover support is also adjustable for varying size beds including twin, full, queen and king.

15 Claims, 4 Drawing Sheets

DIABETIC SHEET SUPPORT

FIELD OF THE DISCLOSURE

A device designed to function with a regular mattress to keep the sheets/blankets lifted off the feet of the individual sleeping.

BACKGROUND

Diabetes is disease that is rapidly spreading throughout the world. More and more people are being diagnosed with diabetes on a regular basis. This disease can range from very mild to very severe. It is not a disease that effects a specific age group. In fact, it is common to find children as well as older adults with diabetes.

Depending on the severity of the disease depends on the amount of symptoms that are present and the degree of the symptoms. The disease to seems to effect the feet of a lot of people who are inflicted with it, especially if the disease is in a more advanced state. An individual can suffer from mild discomfort and irritation in their feet to more advanced swelling. This discomfort can be increased when lying in bed. The weight of the sheet/blanket on their feet can provide undesired distress and uncomfortable effect. This can make it difficult to sleep and create many restless hours. This problem remains relatively unaddressed.

Diabetics are not the only ones that have potential problems which pressure from the sheet/blankets on their feet. People who are exceptionally tall, sometimes experience pressure on their feet, especially when their feet are very close to the end of the bed. Again the weight of the sheet/blankets creates pressure on their feet. This too creates an uncomfortable sleeping environment. If the individual also has any sort of back problems, the pressure placed on the feet compounds the problems in their back.

In U.S. Pat. No. 3,680,158 a bedding support apparatus is disclosed that includes a post means which attaches to the frame of a bed and is capable of being moved upward and downward. The bedding support apparatus includes a cradle section that is capable of extending from the feet to up near the neck section of the bed.

An alternative bed covering apparatus is disclosed in U.S. Pat. No. 4,937,903. In this patent, the bed covering apparatus is attached to the foot board or the frame of an existing bed and then has arms that extend outward over the mattress in a substantially parallel position to around the shoulder area.

One of the options available are those described in U.S. Pat. No. 5,881,406. In this patent, an adjustable blanket support device is disclosed which includes a mounting member which is placed between the mattress an box springs. The sheet raising member 30 will then move upward and downward by an electrical motor.

While there are some options available that could potentially be used, they are substantially more burdensome to use or install and most of them go far beyond the scope of just being able to keep the sheet/blankets lifted off of an individual's feet.

SUMMARY OF THE DISCLOSURE

In one embodiment the bed cover support comprises a first adjustable height bar.

In still another embodiment the bed cover support includes a second adjustable bar.

In yet another embodiment the first adjustable height bar and the second adjustable height bar have a bottom end and a top end.

In another embodiment the bed cover support comprises a first adjustable width bar.

In still another embodiment the first adjustable width bar attaches to an adjustable height bar near said bottom end.

In yet another embodiment the second adjustable width bar attaches to an adjustable height bar near said top end.

In another embodiment the bed cover support includes a support bar extending out from each said adjustable height bars near said bottom end.

In still another embodiment the bed cover support comprises at least two adjustable clamping extensions.

In yet another embodiment the two adjustable clamping extensions operate to cause the mattress to be secured between the adjustable clamping extensions and the support bar.

In another embodiment the adjustable clamping extensions are attached to the second adjustable width bar.

In still another embodiment the bed cover support includes a cover support bar attached to the adjustable height bars on the top end.

In yet another embodiment the cover support bar is concave and extending toward the head of a mattress.

In another embodiment the bed support includes a series of spring clips.

In still another embodiment the spring clips are attached to the first adjustable width bar and operable to attach to the bed covers.

In yet another embodiment the cover support bar includes an extendable cover support extension.

In another embodiment the first adjustable height bar and the second adjustable height bar comprises a spring loaded locking system for adjusting the height of the bed cover support.

In still another embodiment the first adjustable width bar and the second adjustable width bar each comprise a spring loaded locking system.

In yet another embodiment the first adjustable width bar and the second adjustable width bar are capable of adjusting to a full size bed.

In another embodiment the first adjustable width bar and the second adjustable width bar are capable of adjusting to a queen size bed.

In still another embodiment the first adjustable width bar and the second adjustable width bar are capable of adjusting to a twin size bed.

In yet another embodiment of the bed cover support the clamping extensions are covered with a padded material.

Still other advantages of various embodiments will become apparent to those skilled in this art from the following description wherein there is shown and described preferred embodiments of this invention simply for the purposes of illustration. As will be realized, the invention is capable of other different aspects and embodiments without departing from the scope of the invention. Accordingly, the advantages, drawings, and descriptions are illustrative in nature and not restrictive in nature.

DETAILED DESCRIPTION OF THE DRAWING FIGURES

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
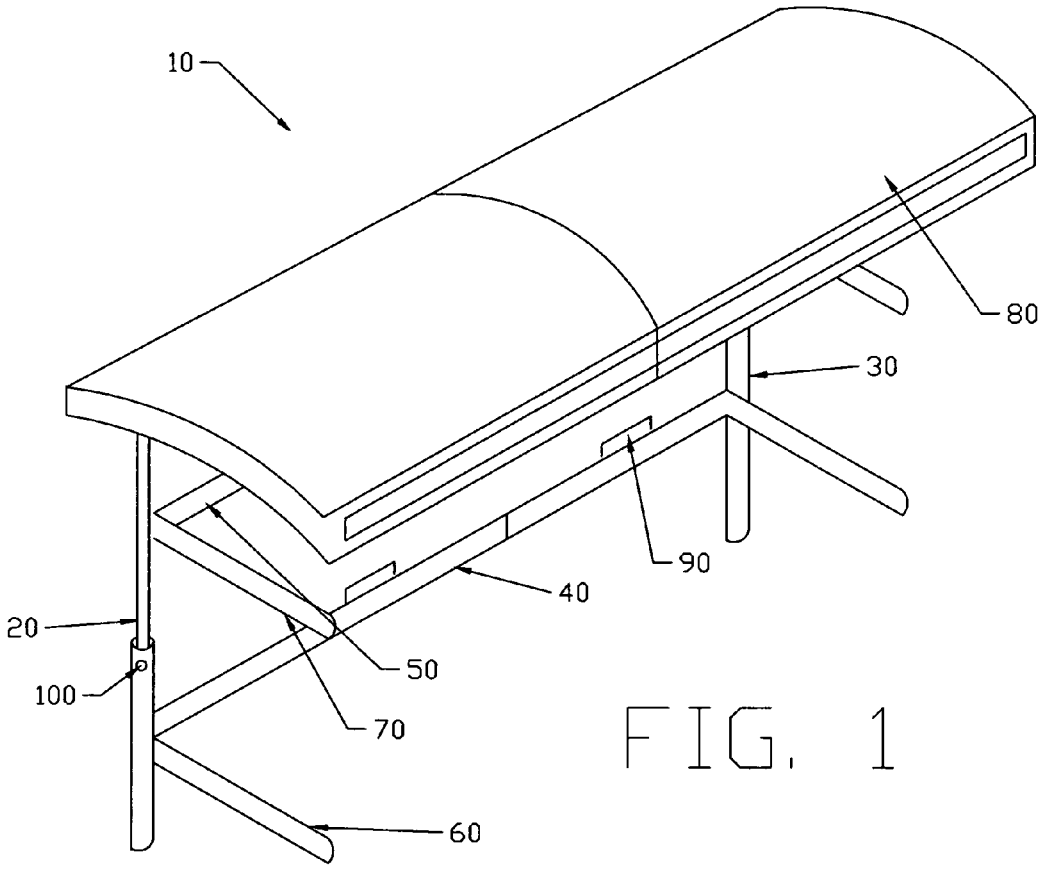
FIG. 1 is a perspective view of a bed cover support.

FIG. 1 depicts a bed cover support 10 having a first adjustable height bar 20, a second adjustable height bar 30, a first adjustable width bar 40, a second adjustable width bar 50, a support bar 60, at least two adjustable clamping extensions 70, a cover support bar 80 and a series of spring clips 90. The first adjustable height bar 20 and the second adjustable height bar 30 are connected by way of the first adjustable width bar 40 which is attached near the bottom of the first adjustable height bar 20 and the second adjustable height bar 30. The second adjustable width bar 50 attaches to the first adjustable height bar 20 and the second adjustable height bar 30 near the top. Both the first adjustable height bar 20 and the second adjustable height bar 30 are capable of being adjusted to varying heights based on the height of a mattress. The first adjustable height bar 20 and the second adjustable height bar 30 are each equipped with a spring loaded locking system 100. Additionally, the first adjustable width bar 40 and the second adjustable width bar 50 are capable of being adjusted to varying widths based on the type of bed, i.e. twin, full, queen or king, by a spring loaded locking system 100. The bed cover support 10 includes a cover support bar 80 which is attached to the top of the first adjustable height bar 20 and the second adjustable height bar 30. The cover support bar 80 is concave and extends toward the head of the mattress. The cover support bar 80 includes an extension 110 that pulls out from inside the cover support bar 80 which allows the distance the cover support bar 80 extends to be increased. By increasing the distance of the cover support bar 80, it is capable of functioning to hold the sheets/blankets off the feet of varying size people. For example, an individual who is six feet tall will not need to have the cover support bar 80 extended as far as someone who is five foot 2 inches tall. Once the bed cover support 10 is adjusted to the proper height and width the adjustable clamping extensions 70 are used to cinch the mattress down to prevent the bed cover support 10 from tipping over. The sheets/blankets are then placed over the bed cover support 10 and attached to the spring clamps which are attached to the first adjustable width bar 40. This keeps the sheets/blankets in place and keeps then from sliding off of the bed cover support 10.

Figure 2:
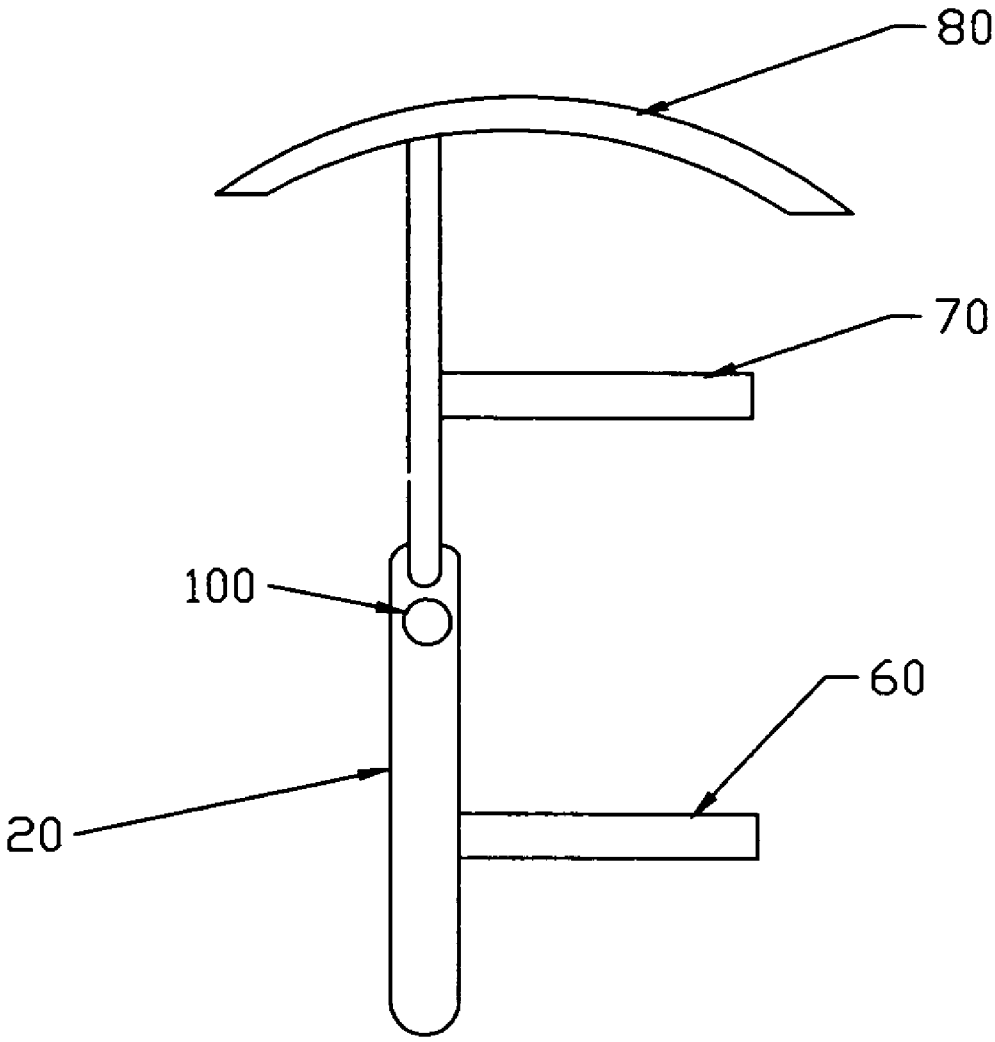
FIG. 2 illustrates a side view of the bed cover support depicted in FIG. 1

FIG. 2 illustrates a side view of the bed cover support 10 and specifically shows the first adjustable height bar 20, the support bar 60 extending from the first adjustable width bar 40 and the adjustable clamping extensions 70 extending from the second adjustable width bar 50. As better shown in this embodiment, the support 60 attached to the first adjustable height bar 20 is designed to slide between a mattress and box springs. The adjustable clamping extensions 70 are then placed on the top of the mattress and the first adjustable height bar 20 and the second adjustable height bar 30 are used to cinch the mattress down and hold the bed cover support 10 in place and prevent it from being pulled over. The adjustable clamping extensions 70 can be covered with a padded material so that they are not rough or cold.

Figure 3:
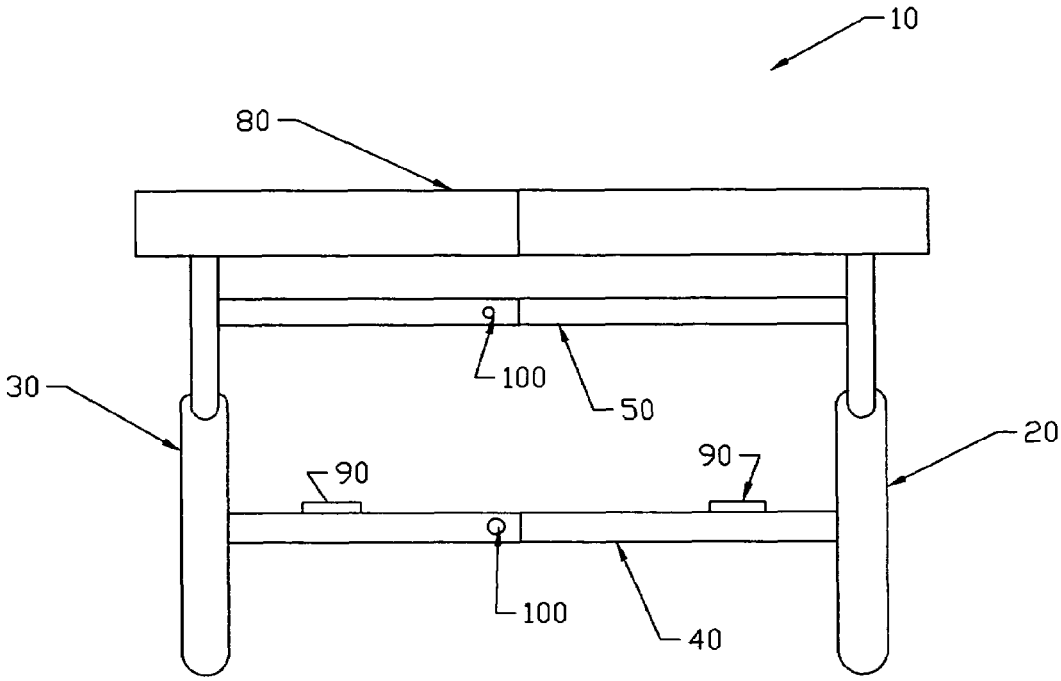
FIG. 3 depicts a back view of a bed cover support of FIG. 1.

FIG. 3 depicts a back view of the bed cover support 10. In this view, the first adjustable width bar 40 and the second adjustable width bar 50 are more clearly depicted. Additionally, the spring clips 90 which are used to hold the covers in place over the bed cover support 10 are illustrated. The spring loaded locking system 100 which is used on the first adjustable width bar 40 and the second adjustable width bar 50 to adjust the width is also show in this illustration.

Figure 4:
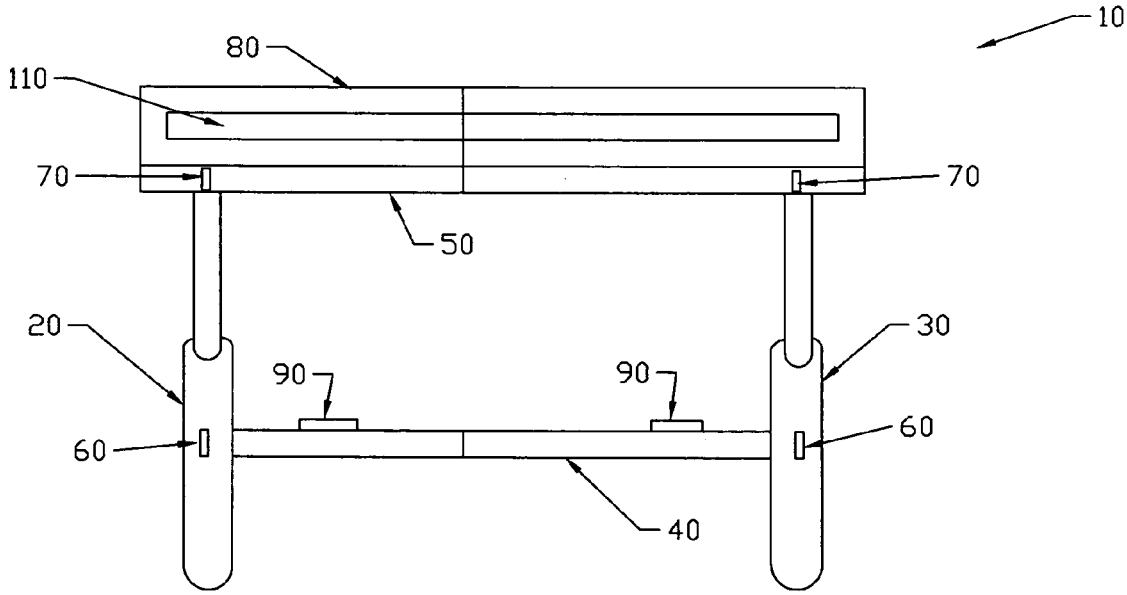
FIG. 4 is a front view of a bed cover support depicted in FIG. 1.

FIG. 4 illustrates a front view of the bed cover support 10 and more specifically shows the extension which extends outward from the cover support bar 80. The extension easily pulled from the cover support bar 80 to adjust for the height of the individual using the bed cover support 10. The spring loaded clips 90 are also shown.

Although an embodiment of the present invention has been shown and described in detail herein, along with certain variants thereof, many other varied embodiments that incorporate the teachings of the invention may be easily constructed by those skilled in the art. Accordingly, the present invention is not intended to be limited to the specific form set forth herein, but on the contrary, it is intended to cover such alternatives, modifications, and equivalents, as can be reasonably included within the spirit and scope of the invention.

What is claimed is:

1. A bed cover support comprising:

a first adjustable height bar and a second adjustable height bar each having a bottom end and a top end;

a first adjustable width bar; wherein each end of said adjustable width bar attaches to adjustable height bar near said bottom end;

a second adjustable width bar, wherein each end of said second adjustable width bar attaches to adjustable height bar near said top end;

a support bar extending out from each of said adjustable height bars near said bottom end;

at least two adjustable clamping extensions operable to cause a mattress to be secured between said adjustable clamping extensions and said support bars; wherein said adjustable clamping extensions are attached to said second adjustable width bar;

a cover support bar attached to said adjustable height bars on said top end, said cover support bar being concave and extending toward the head of the mattress; and a series of spring clips attached to said first adjustable width bar and operable to attach to the bed covers.

2. The bed cover support of claim 1, wherein said cover support bar includes an extendable cover support extension.

3. The bed cover support of claim 1, wherein said first adjustable height bar and said second adjustable height bar comprise a spring loaded locking system for adjusting the height of the bed cover support.

4. The bed cover support of claim 1, wherein said first adjustable width bar and said second adjustable width bar each comprise a spring loaded locking system.

5. The bed cover support of claim 1, wherein said first adjustable width bar and said second adjustable with bar are capable of adjusting to the width of a full size bed.

6. The bed cover support of claim 1, wherein said first adjustable width bar and said second adjustable with bar are capable of adjusting to the width of a queen size bed.

7. The bed cover support of claim 1, wherein said first adjustable width bar and said second adjustable with bar are capable of adjusting to the width of a twin bed.

8. The bed cover support of claim 1, wherein said clamping extensions are covered with a padded material.

9. A bed cover support system comprising:

a first adjustable height bar and a second adjustable height bar each having a bottom end and a top end, wherein said first adjustable height bar and said second adjustable height bar each comprise a spring load locking system;

a first adjustable width bar; wherein each end of said adjustable width bar attaches to adjustable height bar near said bottom end;

a second adjustable width bar, wherein each end of said second adjustable width bar attaches to an adjustable height bar near said top end;

a support bar extending out from each of said adjustable height bars near said bottom end;

at least two adjustable clamping extensions operable to cause a mattress to be secured between said adjustable clamping extensions and said support bar; wherein said adjustable clamping extensions are attached to said second adjustable width bar;

a cover support bar attached to said adjustable height bars on said top end, said cover support bar being concave and extending toward the head of the mattress; and a series of spring clips attached to said first adjustable width bar and operable to attach to the bed covers.

10. The bed cover support of claim 9, wherein said cover support bar includes an extendable cover support extension.

11. The bed cover support of claim 9, wherein said first adjustable height bar and said second adjustable height bar comprise a spring loaded locking system for adjusting the height of the bed cover support.

12. The bed cover support of claim 9, wherein said first adjustable width bar and said second adjustable with bar are capable of adjusting to the width of a full size bed.

13. The bed cover support of claim 9, wherein said first adjustable width bar and said second adjustable with bar are capable of adjusting to the width of a queen size bed.

14. A method of adjusting a bed cover support to support a bed cover above the feet of a person reclining in a bed, the bed cover support comprising:

a first adjustable height bar and a second adjustable height bar each having a bottom end and a top end;

a first adjustable width bar; wherein each end of said adjustable width bar attaches to an adjustable height bar near said bottom end;

a second adjustable width bar, wherein each end of said second adjustable width bar attaches to an adjustable height bar near said top end;

a support bar extending out from each of said adjustable height bars near said bottom end;

at least two adjustable clamping extensions operable to cause a mattress to be secured between said adjustable clamping extensions and said support bars; wherein said adjustable clamping extensions are attached to said second adjustable width bar;

a cover support bar attached to said adjustable height bars on said top end, said cover support bar being concave and extending toward the head of the mattress; and a series of spring clips attached to said first adjustable width bar and operable to attach to the bed covers, wherein the method comprises the steps of:

adjusting the width of the first adjustable width bar and the second adjustable width bar;

adjusting the height of the first adjustable height bar and the second adjustable height bar;

inserting said support bar between the mattress and a box spring located beneath said mattress; and adjusting the clamping extensions so as to secure the mattress between the clamping extensions and the support bar.

15. The method of claim 14 wherein after the adjusting the height step the method further comprises inserting a padded material over said clamping extensions.

* * * * *